US005405725A

United States Patent [19]

Nakamura et al.

[11] Patent Number: 5,405,725

[45] Date of Patent: Apr. 11, 1995

[54] PHOTOCONDUCTOR FOR ELECTROPHOTOGRAPHY

[75] Inventors: Yoichi Nakamura; Sumitaka Nogami, both of Kawasaki; Hideki Komiyama, Shiga, all of Japan

[73] Assignee: Fuji Electric Co., Ltd., Kanagawa, Japan

[21] Appl. No.: 957,178

[22] Filed: Oct. 7, 1992

[30] Foreign Application Priority Data

Oct. 8, 1991 [JP] Japan ..... 3-259505

[51] Int. Cl.[6] ..... G03G 15/02

[52] U.S. Cl. ..... 430/58; 430/72; 430/76

[58] Field of Search ..... 430/58, 72, 76

[56] References Cited

U.S. PATENT DOCUMENTS 4,835,080 5/1989 Takei et al. ..... 430/58

FOREIGN PATENT DOCUMENTS 3635176 4/1987 Germany .
104351 8/1981 Japan .
57-178267 11/1982 Japan .
40566 3/1983 Japan .
62-296150 12/1987 Japan .
63-136055 6/1988 Japan .
1307762 12/1989 Japan .
2139571 5/1990 Japan .

OTHER PUBLICATIONS

English Translation of JP 2-139571. pp. 1-17.
English Translation of JP 63-136055 pp. 1-22.
Japanese Patent Abstracts, vol. 19, p. 172, Electrostatic Charger for Electrophotographic Copier.
Japanese Patent Abstracts, vol. 104, p. 88, Charging Device of Electrophotographic Copier.
Japanese Patent Abstracts, vol. 159, p. 199, Method for Contact Charging in Electrophotography.

*Primary Examiner*—S. Rosasco
*Attorney, Agent, or Firm*—Spencer, Frank & Schneider

[57] ABSTRACT

An electrophotographic photoconductor for an electrophotographic apparatus which employs contact charging, includes a conductive substrate; and a photoconductive layer for contacting an electric conductor, which photoconductive layer includes a charge generating layer which is formed on the conductive substrate and which comprises a binder and a charge generating agent comprised of particles of phthalocyanine pigment or 4,10-dibromoanthanthrone pigment dispersed in the binder; and a charge transporting layer which is formed on the charge generating layer, wherein the particles of pigment have a major axis which does not exceed 1000 nm and a minor axis which is not less than 10 nm, and wherein the particles of pigment have a ratio of the major axis to the minor axis which does not exceed 3. Alternativly, the charge transporting layer is formed on the conductive substrate and the charge generating layer is formed on the charge transporting layer.

2 Claims, 1 Drawing Sheet

PHOTOCONDUCTOR FOR ELECTROPHOTOGRAPHY

BACKGROUND OF THE INVENTION

FIELD OF THE INVENTION

The present invention relates to a photoconductor for electrophotography and more particularly to an organic photoconductor suitable for an electrophotographic apparatus adopting the contact charging system.

DESCRIPTION OF THE PRIOR ART

The image formation of an electrophotographic system discovered by Carlson comprises the steps of charging the surface of a photoconductor for electrophotography (hereinafter to be referred to as a photoconductor) in the dark, forming the latent electrostatic image by exposing the surface of the charged photoconductor to light, developing the formed latent electrostatic image with a toner, transferring the developed toner image to a support such a paper and fixing the toner image on the support. After the image transfer, the photoconductor is subjected to the cleaning process such as the removal of the remaining toner and residual charge and ready to use repeatedly.

In recent years, a photoconductor in which use is made of an organic photoconductive material has been developed and been put into practical use. At present, an organic photoconductor of a functionally separated type has been further developed as a main acceptable product. A photoconductive layer of this type comprises a charge generating layer containing a charge generating agent for generating an electric charge upon absorbing exposure light in the presence of an electric field and a charge transporting layer formed on the charge generating layer and containing mainly a charge transporting agent for transporting the electric charge generated.

In improving a performance required of the charge generating agent, it is required that an absorption coefficient of exposure light is high, a charge generating efficiency upon absorbing exposure light is high and the charge generated moves rapidly. Therefore, the organic pigment is mainly used. The charge generating layer is formed by subliming the organic pigment as the charge generating agent on a conductive substrate or on an undercoat layer formed on the conductive substrate if necessary. The charge generating layer is also formed by coating a coating solution, in which the organic pigment is dispersed or dissolved into a carrier medium together with a binder if necessary, onto the conductive substrate or the undercoat layer formed on the conductive substrate and drying the coating solution. At present, the latter method is largely used in terms of high productivity and operativity. It is required that the organic pigment is easily dispersed into the coating solution and the coating solution is stable so as not to occur a coalescence of the organic pigment during coating or storage. For this reason, it is necessary that the organic pigment usable for the charge generating agent is a particle as fine as possible and the stability of dispersion is improved. To fine the particles of the organic pigment is effective in increasing an absorption coefficient of light. Moreover, the organic pigment usable as the charge generating agent is generally a p-type semiconductor. A hole moves rapidly and an electron is difficult to move among the charges generated in the organic pigment.

Therefore, it is required that the charge generating layer is as thin as possible so as not to be an obstacle to the movement of electrons. For this reason, it is indispensable for the particle of the organic pigment to be as fine as possible. At present, the particle of the organic pigment of the submicron order is used.

On the other hand, a corona discharge such as corotron or scorotron has conventionally played a main role in charging the surface of the photoconductor. However, this charging system produces a product such as ozone or NOx by the corona discharge, deteriorates the photoconductor and leads to environmental destruction. Moreover, since a corona discharge wire and the casing electrode surrounding semicylindrically the wire are provided with a distance from the photoconductor such that they do not contact the latter, there is a problem that the miniaturization of the apparatus is restricted.

For the purpose of solving the problems as mentioned above, a charging system for bringing the conductive material into direct contact with the surface of the photoconductor was devised in place of the charging system by corona discharge. This system is disclosed in Japanese Patent Application Laying-open Nos. 178267/1982, 104351/1981 and 40566/1983. The conductive material may be adopted in the form of a brush, a roller, a plate or a sheet in this charging system. The surface of the photoconductor is charged by bringing it into direct contact with the conductive material and by applying a high voltage to the conductive material.

Since the apparatus of this system can be miniaturized without producing ozone and/or NOx, this does not also lead to the deterioration of the photoconductor or environmental destruction.

The contact charging system has various advantages as mentioned above, but this system has problems as follows:

1) It is difficult to charge over the whole surface of the photoconductor with a uniform surface electric potential.

2) The qualities of image in repeated use of the photoconductor for a long period of time become gradually poor.

3) Defects such as black dots, white spots and blurring happen.

SUMMARY OF THE INVENTION

An object of the present invention is to provide a photoconductor for electrophotography without producing a non-uniformity of image is an electrophotographic apparatus adopting the contact charging system and without producing image defects in repeated use for a long period of time.

In the first aspect of the present invention, a photoconductor for electrophotography comprises:

a conductive substrate;

a charge generating layer formed on the conductive substrate and containing the particles of an organic pigment as a charge generating agent and a binder; and a charge transporting layer formed on the charge generating layer;

in which the largest value of major axes of the particles is not more than 1000 nm, the smallest value of minor axes of the particles is not less than 10 nm and the ratio of the largest value of major axes to the smallest value of minor axes is not more than 3.

In the second aspect of the present invention, a photoconductor for electrophotography comprises:

a conductive substrate;

a charge transporting layer formed on the conductive substrate; and a charge generating layer formed on the charge transporting layer and containing the particles of an organic pigment as a charge generating agent and a binder;

in which the largest value of major axes of the particles is not more than 1000 nm, the smallest value of minor axes of the particles is not less than 10 nm and the ratio of the largest value of major axes to the smallest value of minor axes is not more than 3.

The charge generating agent may be a phthalocyanine-type pigment.

The charge generating agent may be 4, 10-dibromoanthanthrone.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
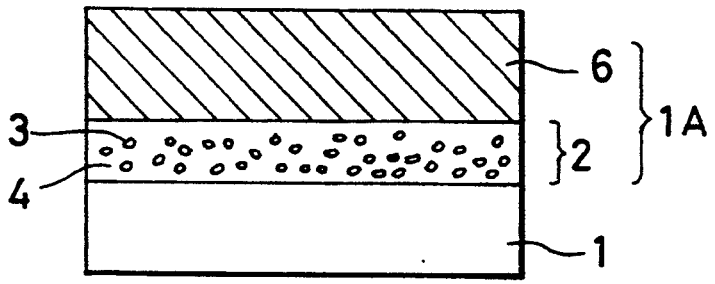
FIGS. 1 and 2 are schematic cross-sectional views of photoconductors according to the present invention, respectively.

FIG. 1 shows a laminate type photoconductor. A laminated photosensitive layer 1A is provided on an electroconductive substrate 1, a lower layer of the laminate is a charge generating layer 2 including a charge generating substance 3 as a main component and a binder 4, and an upper one is a charge transporting layer 6 containing a charge transporting substance.

Figure 2:
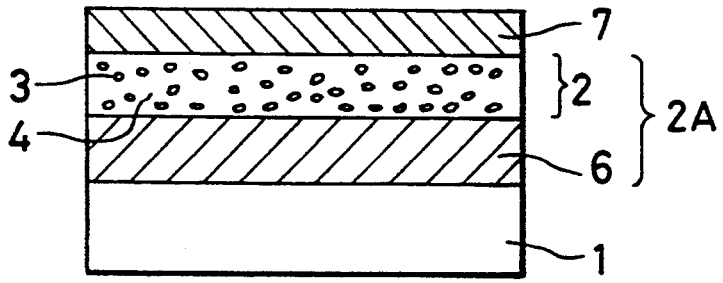

FIG. 2 shows another laminate type photoconductor having a photosensitive layer 2A of the structure in reverse to that of FIG. 1. A laminated photosensitive layer 2A is provided on an electroconductive substrate 1, a lower layer of the laminate is a charge transporting layer 6 including a charge transporting substance and an upper one is the charge generating layer 2 including a charge generating substance 3 and a binder 4. In this case, a covering layer 7 may generally be further provided as shown in FIG. 2 to protect the charge generating layer 2.

A photoconductor as shown in FIG. 1 can be prepared by depositing a charge generating substance on an electroconductive substrate by means of vacuum evaporation or applying and drying a dispersion of a particulate charge generating substance in a solvent and/or a resin binder on an electroconductive substrate, followed by applying a solution containing a charge transporting substance and a resin binder on the resulting layer and drying.

A photoconductor as shown in FIG. 2 can be prepared by applying and drying a solution containing a charge transporting substance and a binder on an electroconductive substrate, and depositing a charge generating substance on the resulting coating layer by means of vacuum evaporation or coating and drying a dispersion of a particulate charge generating substance in a solvent and/or a binder on the coating layer, followed by formation of a covering layer.

The covering layer 7 has a function of receiving and retaining an electric charge generated by corona discharge in the dark and a capability of transmitting light to which the charge generating layer should respond. It is necessary that the covering layer transmits light upon exposure of the photoconductor and allows the light to reach the charge generating layer, and then undergoes the injection of an electric charge generated in the charge generating layer to neutralize and erases a surface electric charge. Materials usable in the covering layer include organic insulating film-forming materials such as polyesters and polyamides. Such organic materials may also be used in mixture with an inorganic material such as a glass resin or $SiO_2$, or a material for lowering electric resistance such as a metal or a metallic oxide. Materials usable in the covering layer are not limited to organic insulating materials for film-forming, and further include inorganic materials such as $SiO_2$, metals, and metallic oxides, which may be formed into a covering layer by an appropriate method such as vacuum evaporation and deposition, or sputtering. From the viewpoint of the aforementioned description, it is desirable that the material to be used in the covering layer be as transparent as possible in the wavelength range in which the charge generating substance attains maximum light absorption.

The conductive substrate has a function for the support of the charge generating layer and the charge transporting layer together with a function for the electrode of the photoconductor. This conductive substrate may be used in the form of a cylinder, a plate or a film. The material of the conductive substrate for use can be a material such as aluminum, aluminum alloy, stainless steel or a conductive plastic.

The surface of the conductive substrate may be coated by a conductive paint in order to flatten the surface if necessary and by an low electric resistance resin such as a solvent-soluble polyamide resin, polyvinyl alcohol, casein, a cellulose derivative, a vinylchloride resin, an acryl resin, a polyether resin in order to give a blocking property. The conductive substrate made of aluminum or aluminum alloy may be also subjected to anodized aluminum treatment in place of the coating of the resin.

An organic pigment usable as the charge generating agent contained in the charge generating layer which is formed on the conductive substrate or on the undercoat layer formed on the conductive substrate includes a phthalocyanine such as metal-free phthalocyanine of an $\alpha$-type and a $\beta$-type, copper phthalocyanine of an $\alpha$-type, a $\beta$-type and an $\epsilon$-type, chloroaluminum phthalocyanine, vanadyl phthalocyanine or titoxy phthalocyanine, a polycyclic quinone such as 3, 9-dibromoanthanthorone, a quinacridone pigment, a perylene pigment or a perynone pigment.

A coating solution prepared by dispersing the organic pigment into a binder and a solvent depending on the type of the organic pigment is applied by the immersion coating, the spray coating, the blade coating or the screen coating onto the conductive substrate and by drying to form the charge generating layer. It is preferable that the ratio of the organic pigment to the binder is within the range from 0.5 part by weight to 20 parts by weight of the organic pigment with respect to 1 part by weight of the binder. Moreover, the charge generating layer is generally formed with a thickness from 0.1 $\mu$m to 2.0 $\mu$m.

According to the present invention, the photoconductor suitable for the electrophotographic apparatus of the contact charging system is obtained by adequately selecting the size and shape of the particles of the organic pigment contained in the charge generating layer. However, since the organic pigment as mentioned above becomes easily a needle crystal, it is required that the organic pigment is ground and dispersed in preparing the coating solution for the charge generating layer in order to obtain the particle of an adequate size and shape.

It is not necessary to use a particularly new grinder and a dispersion mixer in grinding and dispersing the organic pigment. Since an apparatus such as a ball mill, a sand mill or a jet mill has been conventionally used, it is required that the sizes and shapes of the particles of the organic pigment are precisely controlled by adequately selecting the material, the size and the amount of a dispersing agent, the revolution rate of an apparatus, the dispersion time and the compositions of the coating solution. Whichever an apparatus, a method or a condition may be adapted, the effect of the present invention is realized by applying a coating solution, in which the particles of the organic pigment having the size and shape as mentioned above were dispersed, to form the charge generating layer. The size and shape of the organic pigment in the charge generating layer is obtained by directly observing and measuring the particle contained in the coating film by means of an optical microscope or an electron microscope. The particles observed were in the shape of needle-like.

The charge transporting layer is provided on the charge generating layer thus formed. The charge transporting layer is formed by coating onto the charge generating layer a coating solution, in which at least one of the polymeric compounds such as poly(N-vinylcarbazole), poly(vinylanthracene) or polysilane are dissolved, and drying the coating solution. The charge transporting layer is also formed by coating onto the charge generating layer a coating solution, in which at least one of low-molecular weight compounds such as a hydrazone compound, a pyrazoline compound, an enamine compound, a styryl compound, an arylmethane compound, an arylamine compound and a butadiene compound are dissolved into an organic solvent together with a suitable binder, and drying the coating solution.

Binders for use include at least one of various resins such as polycarbonate, polyester, polyurethane, epoxy, silicone, a styrene resin, an acrylic resin or polyketone. It is preferable that the ratio of the low-molecular weight compound to the binder is within the range from 20 parts by weight to 200 parts by weight of the low-molecular weight compound with respect to 100 parts by weight of the binder. It is preferable that a thickness of the charge transporting layer is within the range from 10 μm to 30 μm. An antioxidant and/or an ultraviolet absorption agent may be added in the charge transporting layer if necessary.

Preparation examples of the coating solutions for the charge generating layers are described as follows.

Preparation example 1

1.6 parts by weight of chloroaluminum phthalocyanine chloride refined by sublimation was added into 50 parts by weight of chloroform and 0.2 part by weight of distilled water. This solution was subjected to dispersion treatment by use of a zirconia bead having a diameter of 1.0 mm as a dispersing agent by means of a sand mill at a temperature of −10° C. for 48 hours. This dispersion solution was gradually added by agitating the solution of 0.8 part by weight of isobutylmethacrylate/-butylmethacrylate/2-hydroxymethyl acrylate copolymer (the ratio of each comonomer is 0.45/0.45/0.1 by mol; the weight-average molecular weight Mw=250,000) in 270 parts by weight of chloroform to prepare a coating solution for charge generating layer. This coating solution was applied onto a glass plate to form a coating film with a dry thickness of 0.2 μm. When the phthalocyanine particle were observed by means of the electron microscope (manufactured by Nihon Denshi Co., Ltd.: JSM-T300), the largest value of major axes of the particles was 70 nm, the smallest value of minor axes of the particles was 40 nm and the ratio of the largest value of major axes to the smallest value of minor axes was 1.75.

Preparation example 2

A coating solution was prepared in the same manner as in preparation example 1 except that an atmospheric temperature of the solution containing phthalocyanine is adjusted to 30° C. When the particles of the phthalocyanine in the coating solution were observed in the same manner as in preparation example 1, the largest value of major axes of the particles was 110 nm, the smallest value of minor axes of the particles was 15 nm and the ratio of the largest value of major axes to the smallest value of minor axes was 7.3.

Preparation example 3

1.0 part by weight of copper phthalocyanine of an ε-type was added into 12 parts by weight of cyclohexanone and dispersed for 20 hours by means of a sand mill in the same manner as in preparation example 2. This dispersion solution was gradually added by agitating the solution of 0.5 part by weight of polyvinylbutyral resin (manufactured by Sekisui Chemical Co., Ltd.: Eslec (trademark) BM-2) in 80 parts by weight of methyl ethyl hetone to prepare a coating solution for the charge generating layer. When the particles of the phthalocyanine in the coating solution were observed in the same manner as in preparation example 1, the largest value of major axes of the particles is 1100 nm, the smallest value of minor axes of the particles was 400 nm and the ratio of the largest value of major axes to the smallest value of minor axes was 2.75.

Preparation example 4

A coating solution was prepared in the same manner as in preparation example 3 except that the dispersion time of the phthalocyanine by means of a sand mill was adjusted to 48 hours. When the particles of the phthalocyanine in the coating solution were observed, the largest value of major axes of the particles was 600 nm, the smallest value of minor axes of the particles was 300 nm and the ratio of the largest value of major axes to the smallest value of minor axes was 2.0.

Preparation example 5

10 parts by weight of oxytitanium phthalocyanine having strong diffraction peaks at the Bragg angles ($2\theta \pm 0.2°$) of 9.2°, 13.1°, 20.7°, 26.2° and 27.1° in the X-ray diffraction spectra were added into 10 parts by weight of chloroform. This solution was subjected to dispersion treatment by use of zirconia beads having a diameter of 1.0 mm as a dispersing agent by means of a sand mill at an atmospheric temperature of 30° C. for 20 hours. This dispersion solution was gradually added by agitating the solution of 1.5 parts by weight of polyester resin (manufactured by Toyobo Co., Ltd.: Vylon (Trademark) 200) in 20 parts by weight of cyclopentanone to prepare a coating solution for the charge generating layer.

When the particles of the phthalocyanine in the coating solution were observed in the same manner as in preparation example 1, the largest value of major axes of the particles was 800 nm, the smallest value of minor axes of the particles was 200 nm, the ratio of the largest value of major axes to the smallest value of minor axes was 4.0.

Preparation example 6

1.0 part by weight of oxytitanium phthalocyanine of a preparation example 5 was added into 10 parts by weight of iospropylalcohol. This solution was subjected to dispersion treatment by means of a sand mill with zirconia beads having a diameter of 1 mm as a dispersing agent at a temperature of 5° C. for 40 hours. This dispersion solution was gradually added by agitating the solution of 0.5 part by weight of polyvinylbutyral resin (manufactured by Sekisui Kasei Co., Ltd.: Eslec (Trademark) KS-1) in 20 parts by weight of cyclohexanone to prepare a coating solution for the charge generating layer.

When the particles of the phthalocyanine in the coating solution were observed in the same manner as in preparation example 1, the largest value of major axes of the particles was 500 nm, the smallest value of minor axes of the particles was 200 nm and the ratio of the largest value of major axes to the smallest value of minor axes was 2.5.

Preparation example 7

1.0 part by weight of 4, 10-dibromoanthanthorone (manufactured by ICI Co., Ltd., Monolight red (Trademark) 2Y) refined by sublimation was added into 10 parts by weight of cyclohexanone. This solution was subjected to dispersion treatment by means of a sand mill with zirconia beads having a diameter of 1 mm at an atmospheric temperature of 10° C. for 10 hours.

This dispersion solution was gradually added by agitating the solution of 0.2 part by weight of polyvinylbutyral resin (manufactured by Sekisui Chemical Co. Ltd.,:Eslec (Trademark) BM-1) in 40 parts by weight by cyclohexanone to prepare a coating solution for the charge generating layer. When the particles in the coating solution were observed in the same manner as in preparation example 1, the largest value of major axes of the particles was 1000 nm, the smallest value of minor axes of the particles was 300 nm and the ratio of the largest value of major axes to the smallest value of minor axes was 3.3.

Preparation example 8

A coating solution was prepared in the same manner as in preparation example 7 except that the dispersion time by using a sand mill was adjusted to 24 hours. When the particles in the coating solution were observed, the largest value of major axes of the particle was 500 nm, the smallest value of minor axes of the particles was 250 nm and the ratio of the largest value of major axes to the smallest value of minor axes was 2.0.

Photoconductors were prepared as follows.

Photoconductors 1 to 6

The respective coating solutions for the charge generating layers prepared in preparation examples 1 to 6 as mentioned above was immersion-coated onto the conductive substrates, on which soluble polyamide was coated to the surface of aluminum drum (30 mm in outer diameter, 254.5 mm in length, 1 mm in section thickness and 1.2 μm in a ten-points mean roughness Rz), to become a thickness of 0.1 μm thereby preparing charge generating layers with a dry thickness of 0.4 μm, respectively. Furthermore, the coating solutions of 10 parts by weight of p-diethylamino benzaldehyde-(diphenyl hydrazone) and 10 parts by weight of polycarbonate resin (manufactured by Teizin Kasei Co., Ltd., :TS-2050) in 80 parts by weight of methylene chloride was immersion-coated onto the conductive substrate and then applied onto the charge generating layers to prepare the charge transporting layers with a dry thickness of 20 μm, respectively. Thus, photoconductors 1 to 6 were prepared.

Photoconductors 7 and 8

The respective coating solutions for the charge generating layers prepared in preparation examples 7 and 8 as mentioned above were immersion-coated onto the conductive substrate of a planished aluminum drum (80 mm in outer diameter, 340 mm in length and 1 mm in section thickness) to form the charge generating layer with a dry thickness of 0.8 μm. The coating solution of 10 parts by weight of p-diethylamino benzaldehyde-(diphenyl hydrazone) and 10 parts by weight of polycarbonate resin (manufactured by Teizin Kasei Co., Ltd.,:TS-2050) in 80 parts by weight of methylene chloride was immersion-coated onto the conductive substrate and then applied onto the charge generating layer to form the charge transporting layer with a dry thickness of 25 μm. This photoconductors 7 and 8 were produced.

A phthalocyanine-type pigment was used as a charge generating agent in photoconductors 1 to 6. These photoconductors have sensitivities in a long wavelength light region. Then, these photoconductors were equipped with the laser printer (manufactured by Hewlett Packerd Co. Ltd., Laser Jet II-P), respectively. Image printing-out tests were carried out for a long period of time and the variations of image qualities were examined. The results thus obtained were shown in Table 1. The "l" denotes the largest value of major axes of the particles of the charge generating agent and the "m" denotes the the smallest value of minor axes of the particles of the charge generating agent.

TABLE 1

| | The geometries of the particle of the charge generating agent | | | The quality of image | | | |
|---|---|---|---|---|---|---|---|
| Photoconductor | l(nm) | m(nm) | l/m | At the initial stage | After the image printing-out of 50,000 pages | After the image printing-out of 100,000 pages | After the image printing-out of 200,000 pages |
| | 70 | 40 | 1.75 | The quality of image was good | The quality of image was good | The quality of image was good | The quality of image was good |
| 2 | 110 | 5 | 7.3 | The quality of image | Minute black dots | Large black dots | Many black dots |

TABLE 1-continued

| Photoconductor | The geometries of the particle of the charge generating agent l(nm) | m(nm) | l/m | The quality of image At the initial stage | After the image printing-out of 50,000 pages | After the image printing-out of 100,000 pages | After the image printing-out of 200,000 pages |
|---|---|---|---|---|---|---|---|
| | | | | was good | occurred | occurred | occurred |
| 3 | 1100 | 400 | 2.75 | Minute black dots were found | Minute black dots increased | Large black dots occurred | Many black dots occurred |
| 4 | 600 | 300 | 2.0 | The quality of image was good | The quality of image was good | The quality of image was good | The quality of image was good |
| 5 | 800 | 200 | 4.0 | The quality of image was good | Minute black dots occurred | Large black dots occurred | Many black dots occurred |
| 6 | 500 | 200 | 2.5 | The quality of image was good | The quality of image was good | The quality of image was good | The quality of image was good |

As shown in Table 1, the photoconductors provided with the charge generating layer which contained the charge generating agent with the largest value of major axes "l" not more than 1000 nm, the smallest value of minor axes "m" not less than 10 nm and a ratio "l/m" not more than 3 could maintain good qualities of images even if the photoconductors have been used for a long period of time.

Subsequently, each of photoconductors 7 and 8 was equipped with the copying apparatus of a roller charging system of the contact charging systems, respectively. Image printing-out tests were carried out for a long period of time and the variations of image qualities were examined. The results thus obtained are shown in Table 2.

TABLE 2

| Photoconductor | The geometries of the particle of the charge generating agent l(nm) | m(nm) | l/m | The quality of image At the initial state | After the image printing-out of 50,000 pages | After the image printing-out of 100,000 pages | After the image printing-out of 200,000 pages |
|---|---|---|---|---|---|---|---|
| 7 | 1000 | 300 | 3.3 | Fog was slightly found | Minute black dots occurred | Large black dots occurred | Many black dots occurred |
| 8 | 500 | 250 | 2.0 | The quality of image was good | The quality of image was good | The quality of image was good | The quality of image was good |

As shown in Table 2, the photoconductor provided with the charge generating layer which contained the charge generating agent with the largest value of major axes "l" not more than 1000 nm, the smallest value of minor axes "m" not less than 10 nm and a ratio "l/m" not more than 3 could clearly maintain good qualities of images even if the photoconductor has been used for a long period of time by means of the apparatus of the contact charging system.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An electrophotographic photoconductor which is contact chargeable for an electrophotographic apparatus which employs contact charging, comprising:

a conductive substrate; and a photoconductive layer for contacting an electric conductor, which photoconductive layer is comprised of:

a charge generating layer which is formed on the conductive substrate and which comprises a binder and a charge generating agent comprised of particles of phthalocyanine pigment dispersed in the binder; and a charge transporting layer which is formed on the charge generating layer, wherein the particles of phthalocyanine pigment have a major axis which ranges from 70 to 600 nm and a minor axis which ranges from 40 to 300 nm, and wherein the particles of phthalocyanine pigment have a ratio of the major axis to the minor axis which ranges from 1.75 to 2.5.

2. An electrophotographic photoconductor which is contact chargeable for an electrophotographic apparatus which employs contact charging, comprising:

a conductive substrate; and a photoconductive layer for contacting an electric conductor, which photoconductive layer is comprised of:

a charge transporting layer which is formed on the conductive substrate; and a charge generating layer which is formed on the charge transporting layer and which comprises a binder and a charge generating agent comprised of particles of phthalocyanine pigment dispersed in the binder; and wherein the particles of phthalocyanine pigment have a major axis which ranges from 70 to 600 nm and a minor axis which ranges from 40 to 300 nm, and wherein the particles of phthalocyanine pigment have a ratio of the major axis to the minor axis which ranges from 1.75 to 2.5.

* * * * *